US005441364A

United States Patent [19]

Dressler

[11] Patent Number: 5,441,364

[45] Date of Patent: Aug. 15, 1995

[54] SPLASH BLOCK

[75] Inventor: Robert Dressler, Mechanicsburg, Pa.

[73] Assignee: Alumax Inc., Norcross, Ga.

[21] Appl. No.: 295,009

[22] Filed: Aug. 24, 1994

[51] Int. Cl.[6] ..... E02B 9/04; E04D 13/064; E01C 11/24

[52] U.S. Cl. ..... 405/119; 52/97; 52/169.5; 52/16; D25/112

[58] Field of Search ..... 52/97, 169.5, 11, 16, 52/716.2, 589.1, 604; 404/2; 405/118, 119, 126; 137/312; D25/112

[56] References Cited

U.S. PATENT DOCUMENTS

| | | | |
|---|---|---|---|
| D. 171,737 | 3/1954 | Torricelli | D25/112 |
| D. 181,753 | 12/1957 | Scanland | D25/112 |
| 2,334,779 | 11/1943 | Luff | 405/119 X |
| 3,636,830 | 1/1972 | Watts | 405/119 X |
| 3,745,701 | 7/1973 | Marvin | 405/119 X |
| 4,345,853 | 8/1982 | Fisher | 52/16 X |
| 4,693,633 | 9/1987 | Giordano | 405/119 |
| 5,358,006 | 10/1994 | Sweers | 137/615 |

*Primary Examiner*—Carl D. Friedman
*Assistant Examiner*—Robert J. Canfield
*Attorney, Agent, or Firm*—Jones & Askew

[57] ABSTRACT

A splash block is disclosed of the type placed beneath downspouts to disperse and direct rain water away from buildings. The novel feature of the invention relates to means for coupling two or more splash blocks together to connect the splash blocks, such that the effective length of the splash block can be extended to carry water under force of gravity any desired distance from the building foundation. The splash blocks can be coupled in a straight configuration to extend their length, or they can be coupled in an angled configuration to direct water around obstacles, such as shrubbery.

11 Claims, 6 Drawing Sheets

SPLASH BLOCK

TECHNICAL FIELD

The present invention relates generally to splash blocks for receiving drainage of rain water from a downspout and diverting it away from a building. More specifically, the present invention relates to a splash block comprising means for coupling two or more adjacent splash blocks to carry water for a distance longer than a single splash block and to divert water around an obstacle.

BACKGROUND OF THE INVENTION

A splash block is a structure laid with its top close to the ground surface to receive drainage of rain water from the roof of a building and to carry it away from the building. Traditionally, splash blocks have been comprised of masonry such as concrete or cinder block material. However, because masonry splash blocks are heavy and can easily break or chip if mishandled, other materials such as molded plastic and fiberglass have recently gained favor.

A problem with prior art splash blocks, which typically range from 24 to 36 inches in length, is that the splash block may not be long enough to carry the drainage water a sufficient distance from the foundation of the building. In addition, them are many circumstances in which it would be desirable to convey the water in a non-linear path, for example, to direct the drainage water around a shrub or other obstacle.

Thus there is a need for a splash block system which defines a path which is adjustable in length to provide control over the distance over which the water is carried before being discharged.

There is a further need for a splash block system which can be arranged in a non-linear path to permit drainage water to be diverted around an obstacle such as a shrub.

SUMMARY OF THE INVENTION

Stated generally, the present invention comprises a splash block of the type placed beneath downspouts to disperse and direct rain water away from buildings. The novel feature of the invention relates to means for coupling two or more splash blocks together to connect the splash blocks, such that the effective length of the splash block can be extended to carry water under force of gravity any desired distance from the building foundation. The splash blocks can be coupled in a straight configuration to extend their length, or they can be coupled in an angled configuration to direct water around obstacles, such as shrubbery.

In a first embodiment two pins extending downward from the lower end of a first splash block engage a peripheral annular channel formed in the upper surface of an adjacent second splash block by an interference fit. The pins can engage the annular channel at any locations around its length to permit angulation between the two splash blocks.

In a second embodiment a hole formed in the lower surface of a first splash block mates with a corresponding pin projecting upward from the upper end of an adjacent second splash block. To angle the second block with respect to the first, the pin of the second splash block is simply rotated within the hole of the first block.

In a third embodiment hooks disposed at the lower end of the first splash block are configured to engage an upwardly extending circular wall at the upper end of an adjacent second splash block. The hooks of the first splash block can engage at various locations around the periphery of the wall of the second splash block to permit angulation between the two blocks.

Thus it is an object of the present invention to provide an improved splash block.

It is another object of the present invention to provide a splash block system which is adjustable in length to provide control over the distance which the drainage water is carried before being discharged.

Still another object of the present invention is to provide a splash block system which can carry drainage water along a non-linear path to divert the water around obstacles such as shrubbery and the like.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
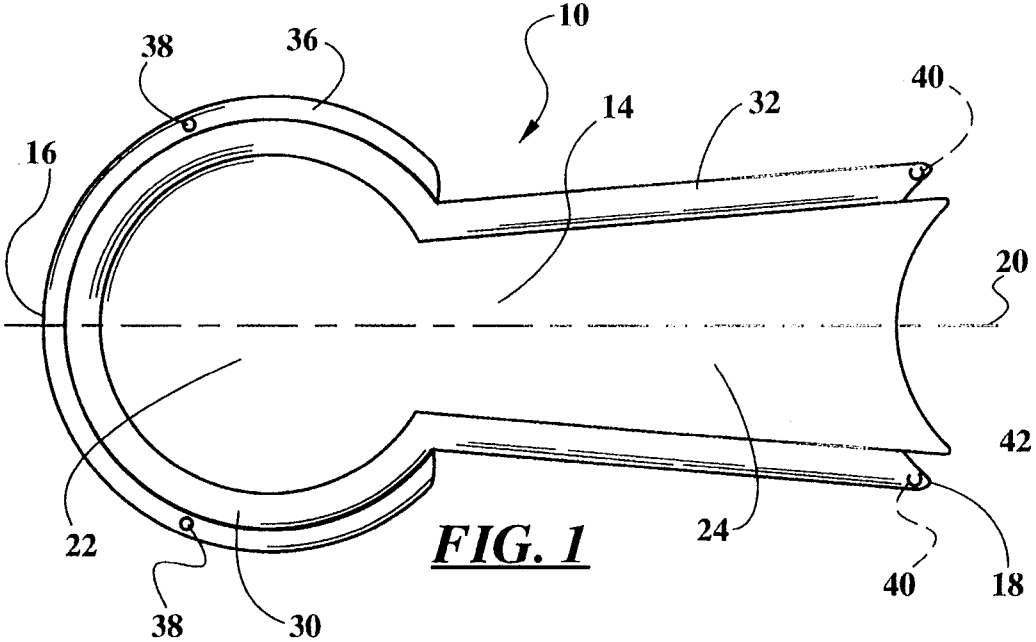
FIG. 1 is a plan view of a first embodiment of a splash block according the present invention.
Figure 2:
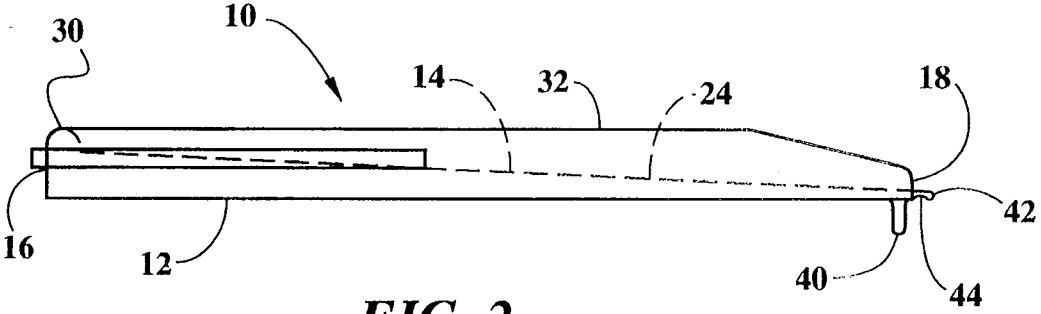
FIG. 2 is an elevation view of the splash block of FIG. 1.

Referring now to the drawings, in which like numerals indicate like elements throughout the several views, FIGS. 1 and 2 depict a first embodiment of a splash block 10 according to the present invention. The splash block 10 is generally keyhole-shaped and has a planar base 12, an upper surface 14, an upper end 16, a lower end 18, and a longitudinal axis 20. The upper surface 14 comprises a circular drainage water receiving section 22 at the upper end of the splash block 10. The upper surface 14 further comprises an elongated trough section 24, into which the drainage water receiving section 22 empties. The upper surface 14 slopes downward from the upper end 16 of the splash block 10 toward the lower end 18.

An annular upper wall section 30 extends upward from the periphery of the drainage water receiving section 22. A pair of opposed side wall sections 32 extend from the ends of the upper wall section 30 and bound the elongated trough section 24. The upper edge of the wall sections 30, 32 extends generally parallel to the planar base 12 of the splash block 10. Thus since the upper surface 14 of the splash block 10 slopes downward, the distance by which the wall sections 30, 32 project above the upper surface 14 increases toward the lower end 18 of the splash block 10.

In the first embodiment of the splash block 10, an annular channel 36 at the upper end 16 of the splash block extends around a major portion of the drainage water receiving section 22 exterior to the upper wall section 30. The channel 36 comprises weep holes 38 for permitting water which may gather within the channel 36 to drain out.

A pair of pins 40 project downward from the base 12 at the lower end 18 of the splash block 10. The pins 40 are disposed on opposite sides of the splash block and lie generally below the side wall sections 32. Also at the lower end 18 of the splash block 10, a forward extending lip 42 has a rounded lower surface 4,4. The contour of the rounded lower surface 44 of the lip 42 matches the contour of the upper surface of the upper wall section 30, for reasons which will become apparent.

Figure 3:
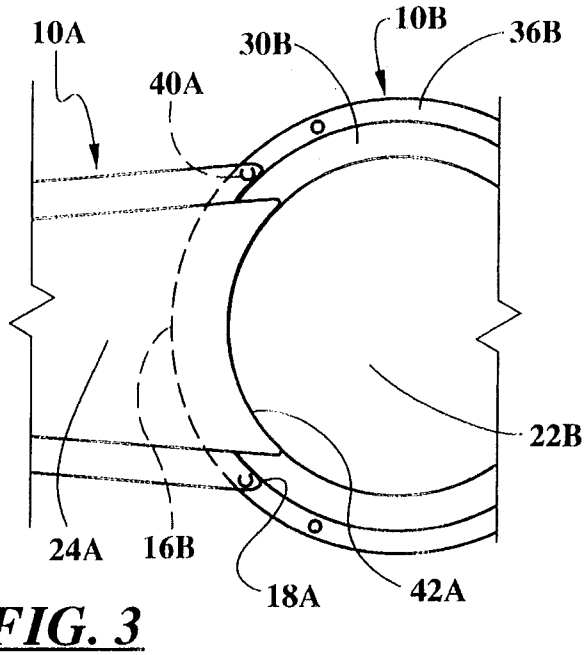
FIG. 3 is partial plan view depicting the cooperative engagement of two splash blocks of the type depicted in FIG. 1.
Figure 4:
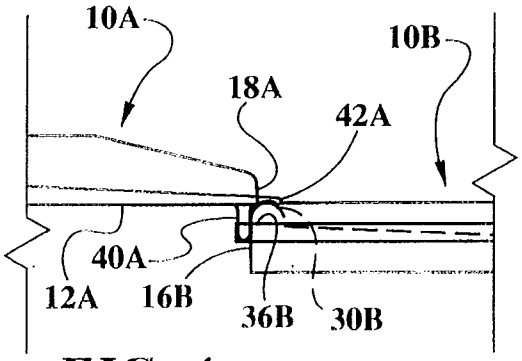
FIG. 4 is a side view depicting the cooperative engagement of two splash blocks of the type depicted in FIG. 1.

FIGS. 3 and 4 depict the cooperative relationship between two identical splash blocks 10A and 10B. For purposes of description, the components of splash block 10A will be the same as those previously described with respect to the splash block 10 with the exception of the "A" suffix. Likewise the components of splash block 10B will be the same as those previously described with respect to the splash block 10 with the exception of the "B" suffix.

As can be seen in FIGS. 3 and 4, the lower end 18A of the splash block 10A couples onto the upper end 16B of the second splash block 10B. The pins 40A which project downward from the base 12A at the lower end 18A of the first splash block 10A fit into the channel 36B at the upper end 16B of the second splash block 10B. The forward extending lip 42A at the lower end 18A of the first splash block 10A rests atop the upper wall section 30B at the upper end 16B of the second splash block. With the splash blocks 10A, 10B so coupled, the trough section 24A of the first splash block 10A empties onto the drainage water receiving section 22B of the second splash block 10B.

Figure 5:
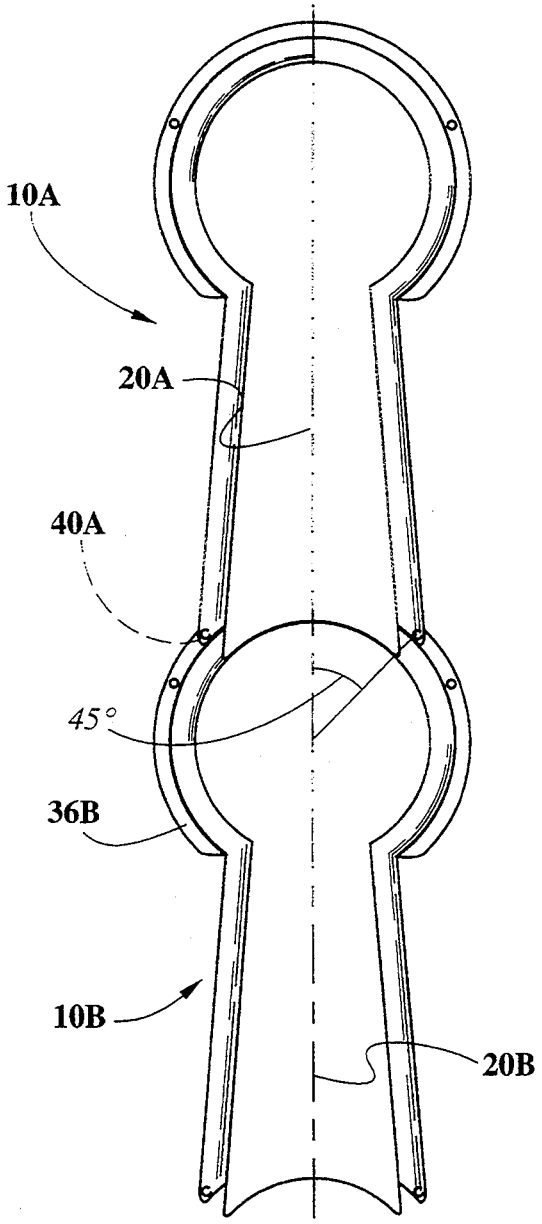
FIG. 5 is a plan view of two splash blocks of the type depicted in FIG. 1 coupled to form a straight-line path.
Figure 6:
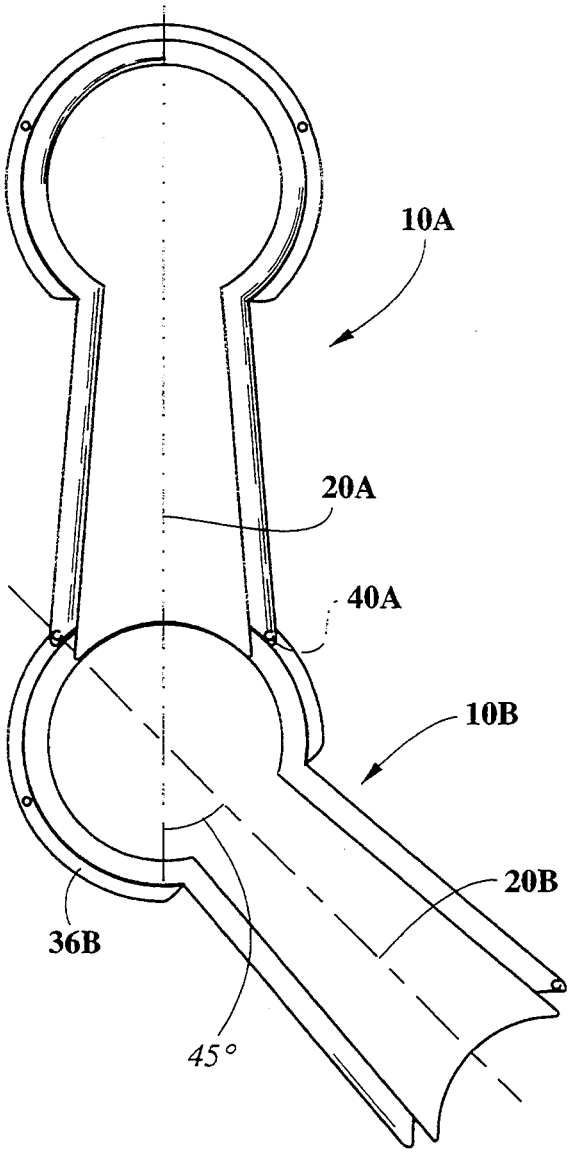
FIG. 6 is a plan view of two splash blocks of the type depicted in FIG. 1 coupled to form a curved path.

FIGS. 5 and 6 illustrate the manner in which two adjacent splash blocks 10A, 10B can be coupled in a variety of configurations. In FIG. 5, the longitudinal axis 20A of the first splash block 10A is aligned with the longitudinal axis 20B of the second splash block. In this configuration, the pins 40A at the lower end 18A of the first splash block engage the annular channel 36B at the upper end 16B of the second splash block at approximately 45° to either side of the longitudinal axis 20B of the; second splash block. In FIG. 6, the longitudinal axis 20A of the first splash block 10A forms a 45° angle with the longitudinal axis 20B of the second splash block. In this configuration, one of the pins 40A of the first splash block engages the annular channel 36B of the second splash block at approximately the longitudinal axis 20B of the second splash block, while the second pin 40A engages the annular channel 36B at a 90° offset to the longitudinal axis 20B. It will be appreciated that the pins 40A can engage the annular channel 36B at any location around the upper end 16B of the second splash block 10B to form any angle from 0° to 90° with respect to the longitudinal axes 20A, 20B of the two splash blocks 10A, 10B.

Figure 7:
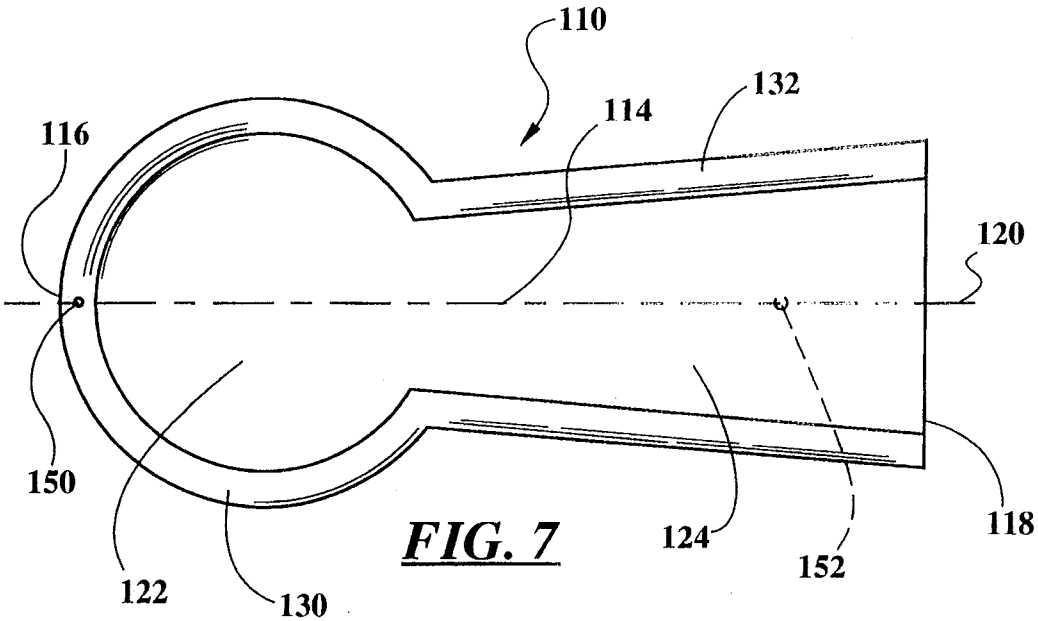
FIG. 7 is a plan view of a second embodiment of a splash block according to the present invention.
Figure 8:
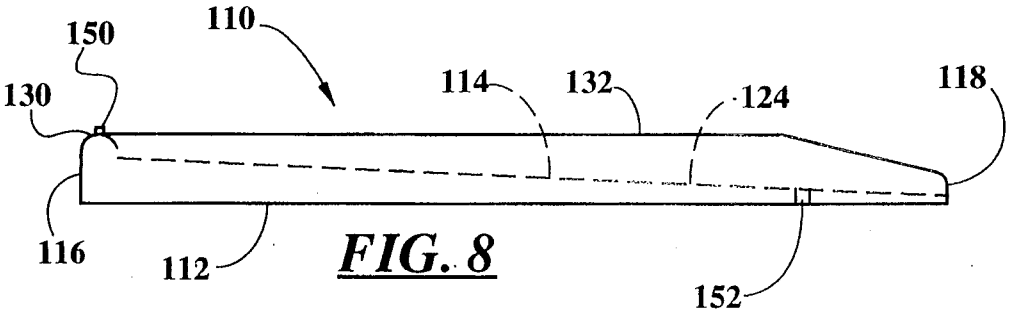
FIG. 8 is an elevation view of the splash block of FIG. 7.

Referring now to FIGS. 7 and 8, a second embodiment of a splash block 110 is depicted. For ease of description, where the splash block 110 has a component previously described with respect to the splash block 10 of the first embodiment, that component will be identified by a number which is exactly 100 more than the corresponding part of the first embodiment. For example, the planar base 112 of the second embodiment 110 will be understood to correspond to the planar base 12 of the first embodiment 10.

Like the splash block 10, the splash block 110 is generally keyhole-shaped and has a planar base 112, an upper surface 114, an upper end 116, a lower end 118, and a longitudinal axis 120. The upper surface 114 comprises a circular drainage water receiving section 122 at the upper end of the splash block 110 and an elongated trough section 124. The splash block 110 also includes an annular upper wall section 130 and a pair of opposed side wall sections 132.

A pin 150 projects upward from the annular upper wall section 130 adjacent the upper end 116 of the splash block 110. A downward opening hole 152 is formed in the base 112 of the splash block 110 adjacent its lower end 118. The pin 150 and hole 152 are configured to fit snugly with the hole and pin of adjacent identical splash blocks 110 but are capable of rotation within the hole and pin of adjacent identical splash blocks, for the purpose to be described below.

Figure 9:
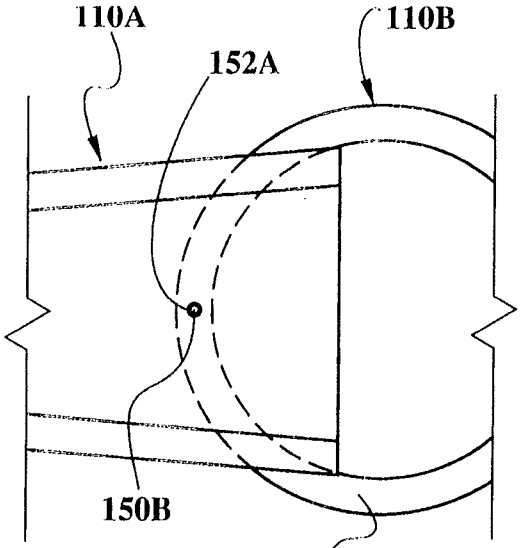
FIG. 9 is a partial plan view depicting the cooperative engagement of two splash blocks of the type depicted in FIG.
Figure 10:
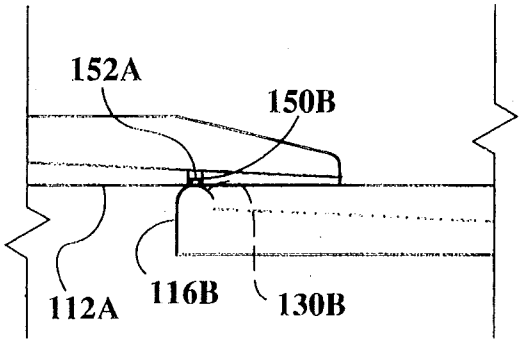
FIG. 10 is a side view depicting the cooperative engagement of two splash blocks of the type depicted in FIG. 7.

FIGS. 9 and 10 illustrate the manner in which two identical splash blocks 110A, 110B couple to one another. As can be seen, the lower end of the base 112A of the first splash block 110 A rests on the annular upper wall section 130B adjacent the upper end 116B of the second splash block 110B, with the pin 150B of the second splash block 110B fitting within the hole 152A in the base 112A of the first splash block 110A.

Figure 12:
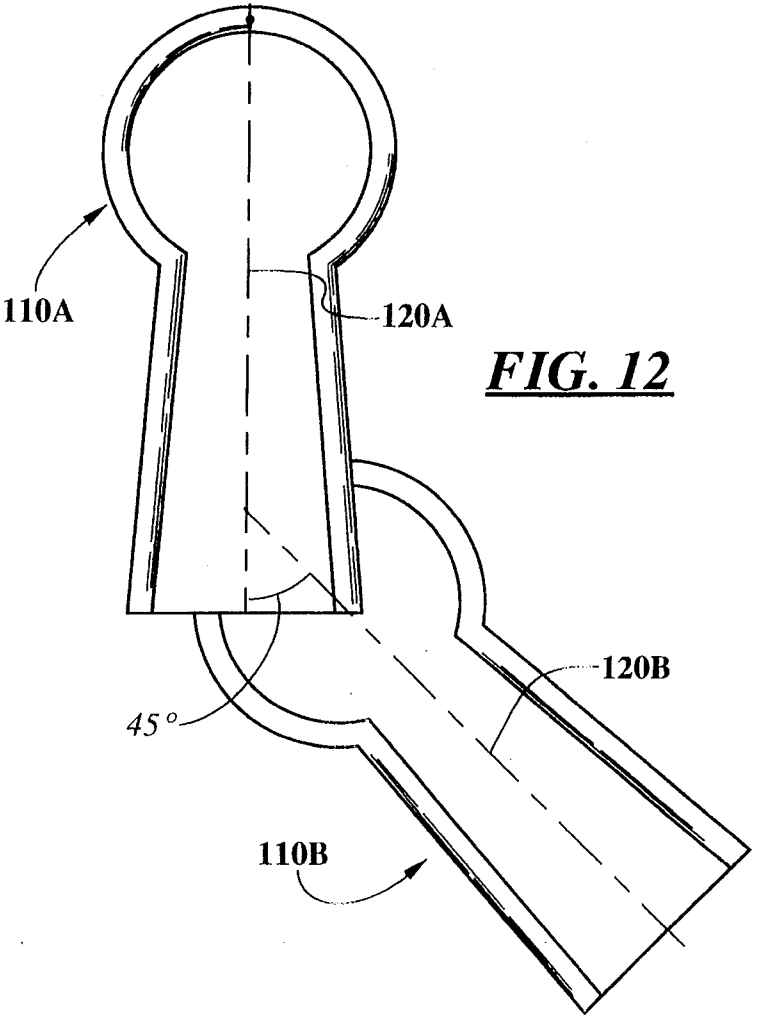
FIG. 12 is a plan view of two splash blocks of the type depicted in FIG. 7 coupled to form a curved path.
Figure 11:
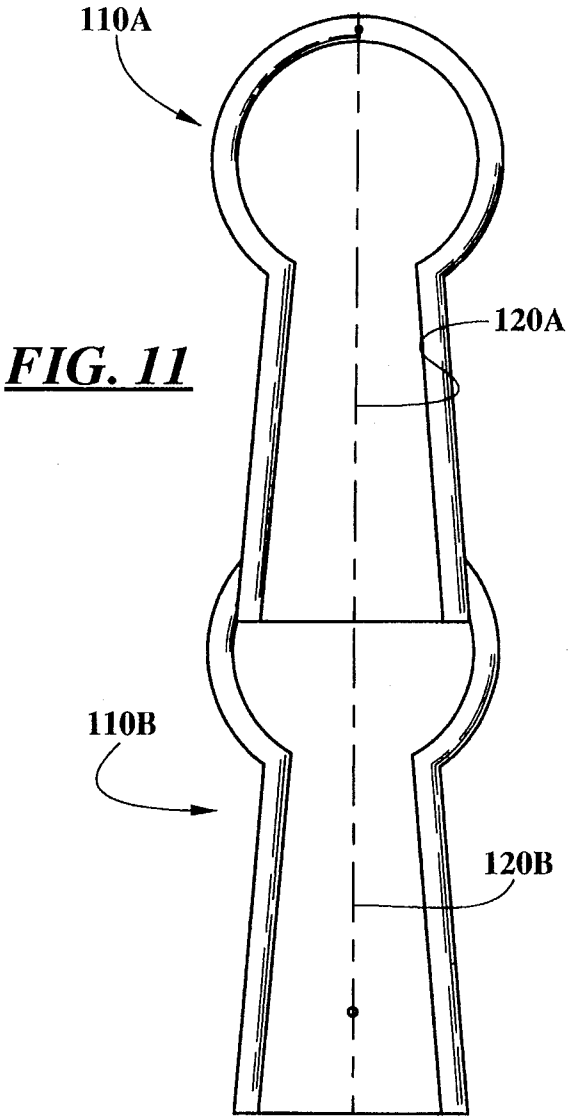
FIG. 11 is a plan view of two splash blocks of the type depicted in FIG. 7 coupled to form a straight-line path.

FIGS. 11 and 12 illustrate the manner in which two adjacent splash blocks 110A, 110B can be coupled in a variety of configurations. In FIG. 11, the longitudinal axis 120A of the first splash block 110A is aligned with the longitudinal axis 120B of the second splash block 110B. To attain the angled configuration illustrated in FIG. 12, in which the longitudinal axis 120A of the first splash block 110A forms a 45° angle with the longitudinal axis 120B of the second splash block 110B, the pin 150B of the second splash block 110B is simply rotated within the corresponding hole 152A in the first splash block 110A. The two splash blocks 110A, 110B are continuously adjustable across a range of from 0° to greater than 90° relative to one another.

Figure 13:
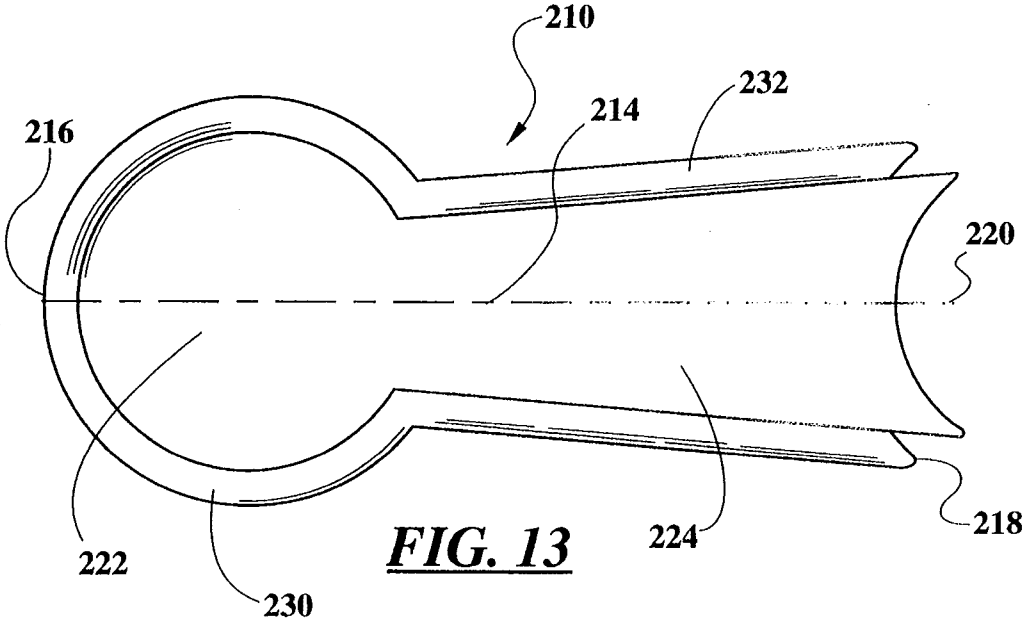
FIG. 13 is a plan view of a third embodiment of a splash block according to the present invention.
Figure 14:
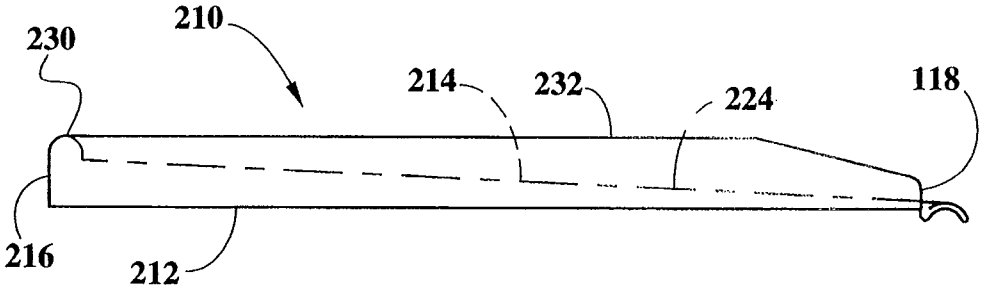
FIG. 14 is an elevation view of the splash block of FIG. 13.

Referring now to FIGS. 13 and 14, a third configuration of a splash block 210 is depicted. For ease of description, those elements of the splash block 210 which correspond to elements previously described with respect to the first embodiment 10 will bear reference numerals which are 200 greater than their corresponding counterparts of the first embodiment. For example, the base 212 of the splash block 210 corresponds to the base 12 of the splash block 10.

Like the previous embodiments, the splash block 210 is generally keyhole-shaped and has a planar base 212, an upper surface 214, an upper end 216, a lower end 218, and a longitudinal axis 220. The upper surface 214 comprises a circular drainage water receiving section 222 at the upper end 216 of the splash block 210 and an elongated trough section 224 extending to the lower end 218 of the splash block. The splash block 110 also includes an annular upper wall section 130 and a pair of opposed side wall sections 132.

The splash block 210 further comprises a hook member 260 extending forward from its lower end 218. The hook member 260 has a concave lower surface 262 which is configured to engage the annular upper wall section 230 of an adjacent identical splash block 210.

Figure 15:
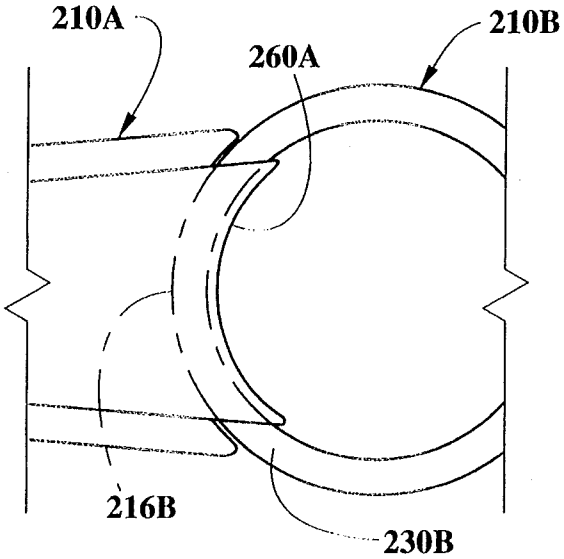
FIG. 15 is a partial plan view depicting the cooperative engagement of two splash blocks of the type depicted in FIG. 13.
Figure 16:
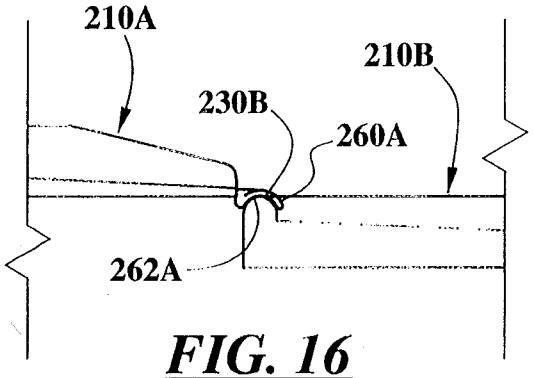
FIG. 16 is a side view depicting the cooperative engagement of to splash blocks of the type depicted in FIG. 13.

FIGS. 15 and 16 depict the manner in which two identical splash blocks 210A, 210B couple to one another. As can be seen, hook member 260A of the first splash block 210A rests on the annular upper wall section 230B adjacent the upper end 216B of the second splash block 210B, with the concave lower surface 262A of the first splash block 210A snugly gripping the wall section 230B of the second splash block 210B.

Figure 17:
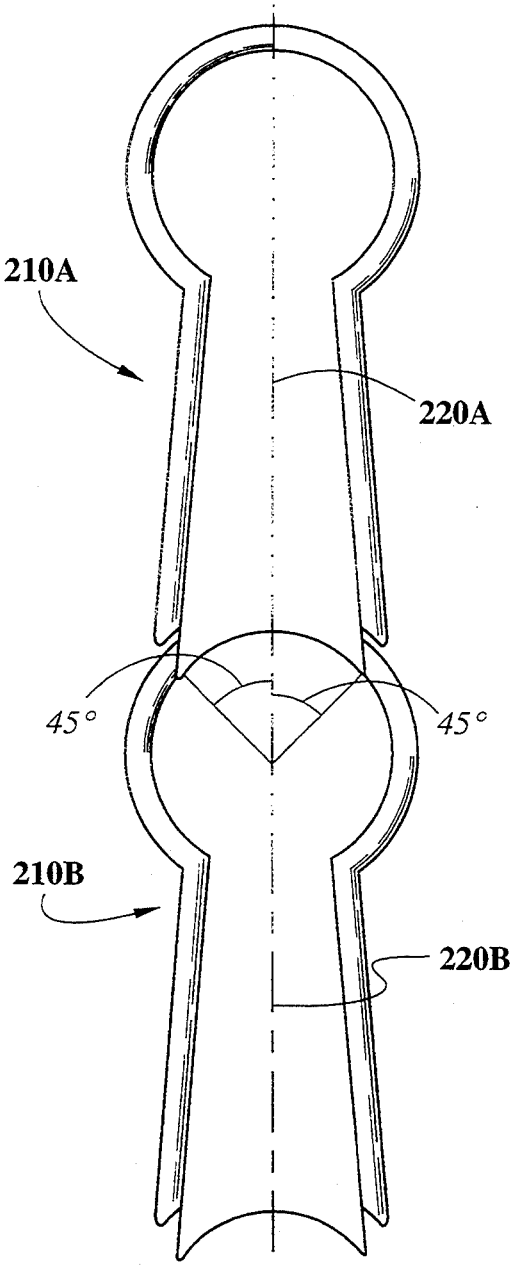
FIG. 17 is a plan view of two splash blocks of the type depicted in FIG. 13 coupled to form a straight-line path.
Figure 18:
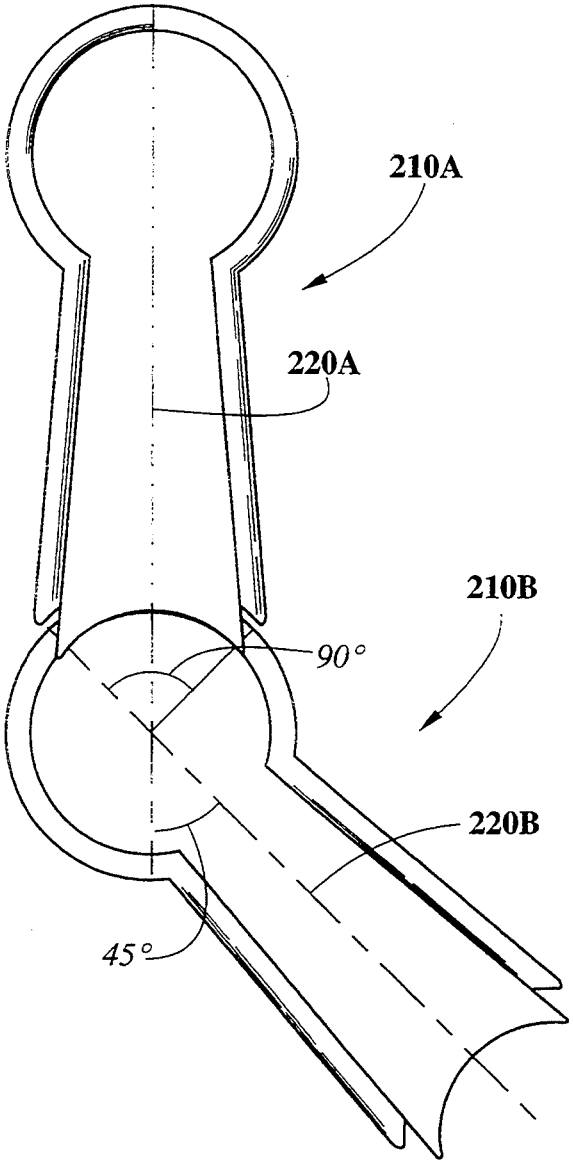
FIG. 18 is a plan view of two splash blocks of the type depicted in FIG. 13 coupled to form a curved path.

FIGS. 17 and 18 depict the manner in which two adjacent splash blocks 210A, 210B can be coupled in various angulated configurations. In FIG. 17, the second splash block 210B is coaxially aligned with the first splash block 210A so that their respective longitudinal axes 220B, 220A are coincident. In this configuration, the hook member 260A of the first splash block 210A proscribes an arc extending approximately 45° to either side of the longitudinal axis 220B of the second splash block. In FIG. 18, the second splash block 210B is angled with respect to the first splash block 210A such that their respective longitudinal axes 220B, 220A form a 45° angle. In this configuration the hook member 260A of the first splash block 210A proscribes an arc extending approximately 90° to one side of the longitudinal axis 220B of the second splash block. Thus by engaging the hook member 260A of the first splash block 210A at various locations around the perimeter of the annular upper wall section 230B of the second splash block 210B, the splash blocks can be arranged such that their respective longitudinal axes 220A, 220B form angles ranging from 0° to approximately 90°.

In the disclosed embodiment 210 the hook member 260 is arcuate and proscribes an angle of approximately 90°, thereby to engage a 90° section of the annular upper wall section 230 of an adjacent identical splash block. However, it will be appreciated that two or more discrete hook members 230 disposed at various points around the arcuate path will also suffice to couple the splash block 210 to an adjacent identical splash block.

Use of the splash blocks 10, 110, 210 should be readily apparent from the drawings, particularly FIGS. 5, 6, 11, 12, 17, and 18. Two or more splash blocks are coupled such that the lower end of one empties onto the water-receiving portion of the adjacent splash block. If it is desired to convey water along a straight-line path, the blocks are coupled in the manners shown in FIGS. 5, 11, and 17 so that the axes of the respective splash blocks are aligned. However, if it is desired to direct water around an obstacle such as a shrub, the blocks can be coupled in the general manners shown in FIGS. 6, 12, and 18 so that the longitudinal axes of the respective blocks are angulated. It will be appreciated that any number of splash blocks can be coupled at any angle or combination of angles to form numerous path configurations as the application may require.

The splash blocks 10, 110, 210 of the disclosed embodiments are preferably formed of molded plastic. However it will be appreciated that other materials, such as molded fiberglass, may be used, or that masonry blocks can be used with metal hooks or pins added to effect coupling.

Finally, it will be understood that the preferred embodiment has been disclosed by way of example, and that other modifications may occur to those skilled in the art without departing from the scope and spirit of the appended claims.

What is claimed is:

1. A splash block for coupling with an adjacent identical splash block for carrying water away from a building, comprising: an upper end;

a water-receiving section disposed adjacent said upper end;

a lower end;

a trough section sloping downward from said upper water-receiving section to said lower end and adapted to discharge water from a lower end thereof;

a channel formed adjacent said upper end of said splash block; and a pair of pins projecting downward from a location adjacent said lower end of said splash block, said pair of pins being configured to be snugly received within the channel of an adjacent identical splash block for coupling said lower end of said splash block to the upper end of said adjacent identical splash block.

2. The splash block of claim 1, wherein said channel comprises an annular channel.

3. The splash block of claim 2, wherein said water-relying section is circular, and wherein said annular channel is disposed around the periphery of said circular water-receiving section.

4. The splash block of claim 1, wherein said splash block further comprises:

a peripheral wall bounding said water-receiving section and said trough section; and a lip formed at said lower end of said splash block, said lip being configured to rest upon the peripheral wall at the upper end of said adjacent identical splash block when said pins of said splash block engage said channel of said adjacent identical splash block.

5. The splash block of claim 4, wherein said peripheral wall has a rounded upper edge, and wherein said lip comprises a bottom portion which is rounded so as to cooperatively engage the rounded upper edge of said identical adjacent splash block.

6. The splash block of claim 1, wherein said channel is configured to receive said pins at a plurality of locations therewithin, whereby said splash block and said adjacent identical splash block can be angulated relative to one another.

7. A splash block for coupling with an adjacent identical splash block for carrying water away from a building, comprising:

an upper end;

a water-receiving section disposed adjacent said upper end;

a lower end;

a trough section sloping downward from said upper water-receiving section to said lower end and adapted to discharge water from a lower end thereof;

an upwardly extending pin formed adjacent said upper end of said splash block; and a downward opening hole formed in said splash block adjacent said lower end thereof, said hole being dimensioned to snugly receive the pin adjacent the upper end of an adjacent identical splash block for coupling said lower end of said splash block to the upper end of said adjacent identical splash block.

8. The splash block of claim 7 wherein said pin and stud hole are configured to permit rotation of the pin of an adjacent identical splash block with said downward opening hole of said splash block, whereby said splash block and said adjacent identical splash block can be angulated relative to one another.

9. A splash block for coupling with an adjacent identical splash block for carrying water away from a building, comprising:

an upper end;

a water-receiving section disposed adjacent said upper end;

a lower end;

a trough section sloping downward from said upper water-receiving section to said lower end and adapted to discharge water from a lower end thereof; and a hook member disposed at said lower end of said splash block, said hook member being configured to engage the upper end of an adjacent identical second splash block for coupling said lower end of said splash block to the upper end of said adjacent splash block.

10. The splash block of claim 9, wherein said splash block further comprises:

a peripheral wall bounding said water-receiving section and said trough section; and said hooks being configured to engage the peripheral wall of an adjacent identical splash block.

11. The splash block of claim 10 wherein said hooks are configured to engage the peripheral wall of said adjacent identical splash block at a plurality of locations around said peripheral wall, whereby said splash block and said adjacent identical splash block can be angulated relative to one another.

* * * * *